US005695413A

United States Patent [19]

Yamagishi et al.

[11] Patent Number: 5,695,413

[45] Date of Patent: Dec. 9, 1997

[54] SOLID GOLF BALL

[75] Inventors: Hisashi Yamagishi; Hiroto Sasaki; Hideo Watanabe; Yasushi Ichikawa; Hiroshi Higuchi, all of Chichibu, Japan

[73] Assignee: Bridgestone Sports Co., Ltd., Tokyo, Japan

[21] Appl. No.: 634,615

[22] Filed: Apr. 19, 1996

[30] Foreign Application Priority Data

Apr. 26, 1995 [JP] Japan ..... 7-125966

[51] Int. Cl.[6] ..... A63B 37/06; A63B 37/12

[52] U.S. Cl. ..... 473/374; 473/377; 473/378; 473/351; 273/DIG. 22

[58] Field of Search ..... 473/377, 385, 473/374; 273/DIG. 22

[56] References Cited

U.S. PATENT DOCUMENTS 5,439,227 8/1995 Eggshira et al. ..... 473/377 X 5,492,972 2/1996 Stefani ..... 473/385 X

FOREIGN PATENT DOCUMENTS 2 276 628 5/1994 United Kingdom .

*Primary Examiner*—George J. Marlo

*Attorney, Agent, or Firm*—Sughrue, Mion, Zinn, Macpeak & Seas, PLLC

[57] ABSTRACT

In a solid golf ball comprising a solid core and a cover, the solid core has a distortion of 3.5–5.0 mm under a load of 100 kg, and the cover based on an ionomer resin has a Shore D hardness of 50°–63° and a 300% modulus of 15–35 MPa. The ball offers a soft feel while maintaining the characteristics of solid golf balls.

11 Claims, 1 Drawing Sheet

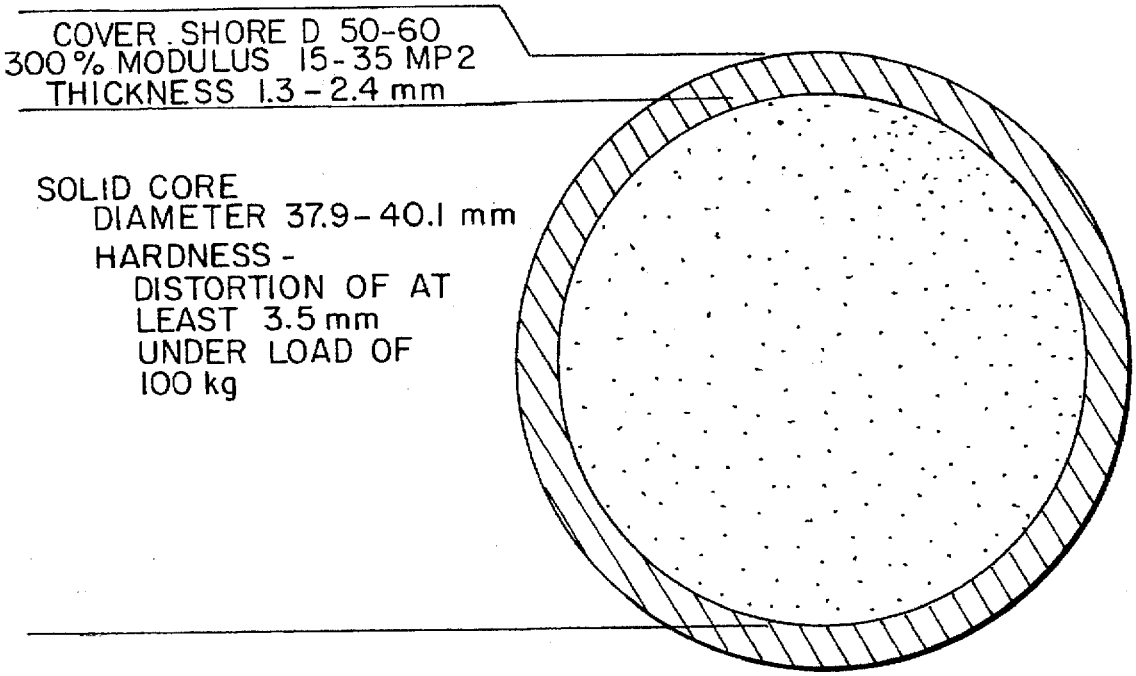
FIG. 1
FIG. 2
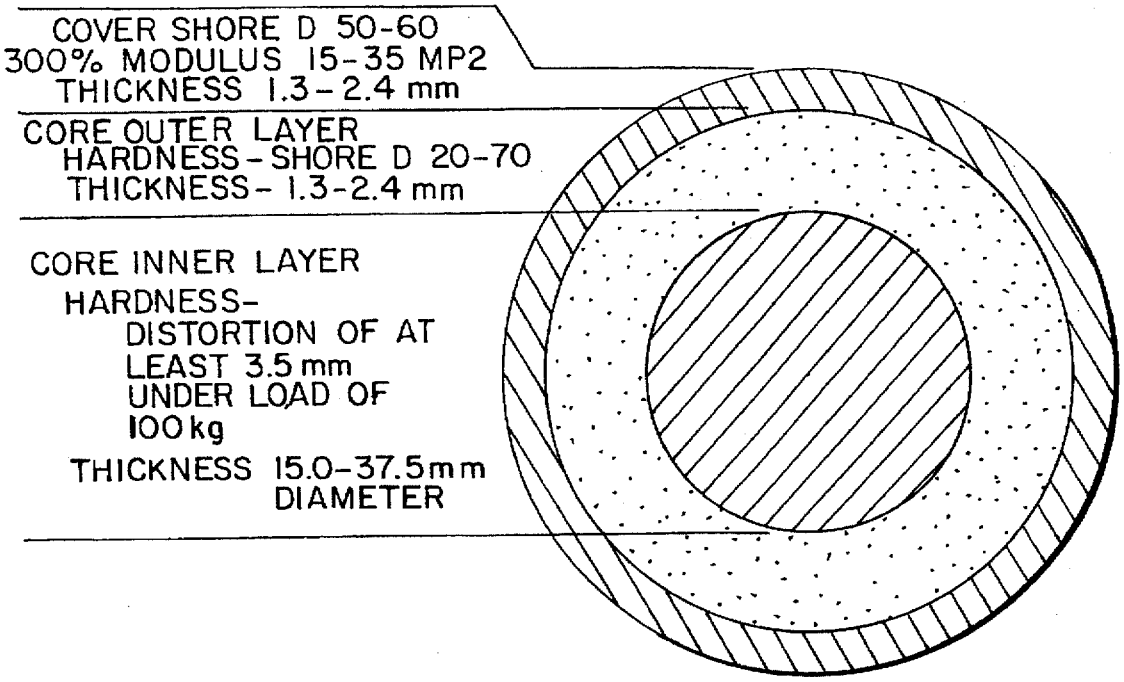

SOLID GOLF BALL

BACKGROUND OF THE INVENTION

1. Field of the Invention

This invention relates to a solid golf ball having improved flying performance, durability and pleasant feel.

2. Prior Art

Solid golf balls such as two-piece golf balls generally include a core and a cover enclosing the core. Many golfers use two-piece golf balls because they are superior in flying distance and durability. Two piece golf balls, however, present a harder hitting feel than thread wound golf balls and are inferior in feeling and control because they quickly leave the club head. Therefore, many professional golfers and skilled golfers who take feeling and control into greater account favor thread wound golf balls, especially thread wound golf balls with a soft balata cover. However, the thread wound golf balls are inferior to the two-piece golf balls with respect to flying distance and durability.

Since solid golf balls and thread wound golf balls have contradictory performance as mentioned above, golfers choose golf balls in accordance with their skill and favor.

In order to impart a feeling like thread wound golf balls to solid golf balls, Japanese Patent Application Kokai (JP-A) Nos. 319830/1994 and 24085/1995 propose to use soft cores in solid golf balls. Such soft cores are enclosed with relatively hard covers. However, we have found that a ball having a soft core enclosed with a hard cover is rather less durable, produces an undesirably keen sound upon hitting and gives a less pleasant feel.

SUMMARY OF THE INVENTION

An object of the invention is to provide a solid golf ball which is improved in feel while maintaining flying performance and durability inherent to solid golf balls. Another object of the invention is to provide a solid golf ball having improved total balance.

In a golf ball comprising a solid core and a cover enclosing the core, the invention uses a soft core, more specifically, a core having a hardness expressed by a distortion of at least 3.5 mm under a load of 100 kg. This soft core is combined with a cover composed mainly of a soft ionomer resin and having a Shore D hardness of 50 to 63 and a 300% modulus of 15 to 35 MPa. Although both the core and the cover are soft, quite unexpectedly, the resulting solid golf ball travels a satisfactory flying distance, is fully durable, and offers a pleasant feel upon hitting.

It is generally believed that if a core and a cover are made soft, restitution is lost due to the shortage of hardness, leading to a reduced flying distance and durability is low. The approach of softening both a core and a cover is regarded opposed to the purpose of obtaining a solid golf ball which is improved in feel while maintaining good flying performance and durability. Through extensive investigations, we have found that unexpected results are obtained by carefully selecting a core hardness and a cover hardness. That is, when a core having a distortion of at least 3.5 mm under a load of 100 kg as a hardness parameter is enclosed with a cover composed mainly of an ionomer resin and having a Shore D hardness of 50 to 63 and a 300% modulus of 15 to 35 MPa, there is obtained a solid golf ball which offers a pleasant soft feel while maintaining satisfactory flying performance and durability.

BRIEF DESCRIPTION OF THE DRAWING

FIG. 1 is a schematic cross-section of a two-piece golf ball in accordance with this invention; and FIG. 2 is a schematic cross-section of a three-piece golf ball in accordance with this invention.

DETAILED DESCRIPTION OF THE INVENTION

In the golf ball of the invention, the solid core should have a hardness expressed by a distortion of at least 3.5 mm under a load of 100 kg, and the cover is composed mainly of an ionomer resin and should have a Shore D hardness of 50 to 63 and a 300% modulus of 15 to 35 MPa.

The core hardness is expressed by a distortion or compression (mm) under a load of 100 kg. In the present invention, the core hardness is at least 3.5 mm, preferably 3.5 to 5.0 mm, especially 3.8 to 4.8 mm as expressed by a distortion under a load of 100 kg. If the distortion is less than 3.5 mm, a fully soft pleasant feel is not obtainable. If the distortion is more than 5.0 mm, restitution would be somewhat lost, resulting in a shorter flying distance.

It is noted that the invention is applicable not only to two-piece golf balls having a single core, see FIG. 1, but also to multi-core golf balls such as three-piece golf balls wherein the core consists of two inner and outer layers or more see FIG. 2. In the case of a three-piece golf ball wherein the core consists of two inner and outer layers, the core hardness as defined herein is the hardness of the two-layer spherical core as entirety. Differently stated, the core hardness is the hardness of the entire spherical core excluding the cover. In the case of a three-piece golf ball as illustrated in FIG. 2, the inner center sphere of the solid core should preferably have a distortion of at least 3.5 mm, especially at least 3.8 mm under a load of 100 kg and a diameter of 15.0 to 37.5 mm, especially 30.0 to 37.0 mm. The outer layer of the solid core should preferably have a Shore D hardness of 20 to 70, especially 25 to 60 and a thickness of 1.3 to 2.4 mm, especially 1.5 to 2.3 mm.

The solid core should preferably have a diameter of 37.9 to 40.1 mm, especially 38.0 to 39.8 mm.

Used as the cover of the solid golf ball according to the invention is a cover based on an ionomer resin having a Shore D hardness of 50 to 63, especially 55 to 60 and a 300% modulus of 15 to 35 MPa, especially 17 to 32 MPa. A Shore D hardness in excess of 63 detracts from durability and feeling whereas a Shore D hardness of less than 50 detracts from restitution and a flying distance. A 300% modulus of more than 35 MPa detracts from durability whereas a 300% modulus of less than 15 MPa detracts from restitution.

Preferably the cover has a radial thickness of 1.3 to 2.4 mm, especially 1.5 to 2.3 mm.

In the practice of the invention, the material and preparation method of the core are not critical. Insofar as the golf ball exhibits the above-mentioned features, the core may be prepared from a well-known material by a conventional method.

More particularly, the core of the solid golf ball of the invention is prepared from a rubber composition by a conventional method while adjusting the formulation and vulcanizing conditions. Usually, the core is formed of a composition comprising a base rubber, crosslinking agent, co-crosslinking agent, and inert filler. The base rubber may be selected from natural rubber and synthetic rubber which are used in conventional solid golf balls. It is preferred to use 1,4-polybutadiene having at least 40% of cis-structure. If desired, the polybutadiene is blended with natural rubber, polyisoprene rubber, styrene-butadiene rubber or the like. The crosslinking agent is typically selected from organic peroxides such as dicumyl peroxide and di-t-butyl peroxide, especially dicumyl peroxide. About 0.5 to 3 parts by weight, preferably about 0.8 to 1.5 parts by weight of the crosslinking agent is blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. About 10 to 40 parts by weight, preferably about 15 to 35 parts by weight of the co-crosslinking agent is blended with 100 parts by weight of the base rubber. Examples of the inert filler include zinc oxide, barium sulfate, silica, calcium carbonate, and zinc carbonate, with zinc oxide and barium sulfate being often used. The amount of the filler blended is preferably 5 to about 30 parts by weight, especially 10 to 25 parts by weight per 100 parts by weight of the base rubber although the amount largely varies with the specific gravity of the core and cover, the weight of the ball, and other factors. In the practice of the invention, the amount of the filler (typically zinc oxide and barium sulfate) is properly selected so as to provide an optimum hardness to the core.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining a core.

Where the core consists of an inner layer and an outer layer (intermediate layer as viewed in a ball) as in the three-piece ball (FIG. 2), the inner layer (core) may be formed of a composition similar to the above and the outer layer may be formed of a composition similar to the above or another resin composition based on an ionomer resin or the like. The outer layer can be formed on the inner core by compression molding or injection molding.

The cover is formed of a composition based on an ionomer resin satisfying the above-mentioned requirements. Such requirements are conveniently met by a mixture of two or more ionomer resins. If desired, well-known additives such as titanium white may be added to the ionomer resin(s). The cover composition may be molded over the core by any desired method, for example, by surrounding the core by a pair of preformed hemispherical cups followed by heat compression molding or by injection molding the cover composition over the core.

The golf ball of the invention is prepared in accordance with the Rules of Golf, that is, to a diameter of at least 42.67 mm and a weight of not greater than 45.92 grams.

The inventive golf ball travels a satisfactory flying distance, is fully durable, and offers a pleasant soft feel on hitting.

EXAMPLE

Examples of the present invention are given below by way of illustration and not by way of limitation. All parts are by weight.

Examples 1–6 & Comparative Examples 1–2

Solid cores were molded by vulcanizing a rubber composition comprising cis-1,4-polybutadiene rubber, zinc acrylate, zinc oxide, and dicumyl peroxide in a mold while changing the formulation so that the core might have a hardness expressed by a distortion (mm) under a load of 100 kg as shown in Table 1.

The basic composition of the core is shown below.

| Core components | Parts |
|---|---|
| Cis-1,4-polybutadiene rubber | 100 |
| Zinc acrylate | X (see Table 1) |
| Zinc oxide | 10 |
| Barium sulfate | Y (see Table 1) |
| Antioxidant | 0.2 |
| Dicumyl peroxide | 0.9 |

Core Nos. 1 to 6 having varying hardness were obtained by changing the amount of zinc acrylate and barium sulfate as shown in Table 1.

It is noted that core No. 6 is a two-layer core for a three-piece golf ball wherein the inner layer or core was formed from the above-mentioned composition containing zinc acrylate and barium sulfate in the amounts shown in Table 1 to a diameter of 35.1 mm. This inner core had a distortion of 4.4 mm under a load of 100 kg. A polyester thermoplastic resin (having a Shore D hardness of 40°) was molded over the inner core to form the outer layer having a thickness of 1.8 mm.

Himilan ionomer resins (manufactured by Mitsui-duPont Polychemical K.K.) were blended in a weight ratio as shown in Table 2, obtaining covers A to D having a Shore D hardness and a 300% modulus as shown in Table 2.

Golf balls of Examples 1–6 and Comparative Examples 1–2 were prepared by combining the cores and the covers as shown in Table 3. The balls of Examples 1–5 and Comparative Examples 1–2 are two-piece golf balls and the ball of Example 6 was a three-piece golf ball having a dual core.

TABLE 1

| Core No. | Core hardness (mm) | Amount of zinc acrylate X (pbw) | Amount of barium sulfate Y (pbw) |
|---|---|---|---|
| 1 | 3.0 | 30 | 11.2 |
| 2 | 4.0 | 23 | 11.7 |
| 3 | 4.0 | 23 | 14.3 |
| 4 | 4.2 | 21 | 15.3 |
| 5 | 4.6 | 17 | 19.3 |
| 6 | 4.2 | 19 (inner) | 16.3 (inner) |

TABLE 2

| | Cover | | | |
|---|---|---|---|---|
| | A | B | C | D |
| Blend, wt % | | | | |
| Himilan 1855 | 50 | 50 | — | — |
| Himilan 1856 | 50 | — | — | — |
| Himilan 1601 | — | 50 | 50 | — |
| Himilan 1705 | — | — | 50 | — |
| Himilan 1706 | — | — | — | 50 |
| Himilan 1605 | — | — | — | 50 |
| Shore D hardness | 55 | 58 | 60 | 64 |
| 300% modulus, MPa | 19 | 22 | 25 | 30 |

The golf balls were examined for flying performance, feeling and durability by the following tests.

Flying Test

Using a swing robot, a sample ball was hit by a driver at a head speed (HS) of 40 m/s to measure a carry and a total flying distance.

Feeling Test

In a sensory test using a panel of golfers who swing at a head speed of 40 m/sec., a sample ball was evaluated for hitting feel and rated "VS" when it gave a very soft feeling, "Soft" when it gave a soft feeling, and "Hard" when it gave a hard feeling.

Durability

Using a flywheel hitting machine M/C, a sample ball was repeatedly hit at a head speed of 38 m/sec. until the ball was broken. The number of hits was counted. The ball was rated "Good" when it was fully durable, "Fair" when it was fairly durable, and "Poor" when it was weak.

TABLE 3

| | E1 | E2 | E3 | E4 | E5 | E6 | CE1 | CE2 |
|---|---|---|---|---|---|---|---|---|
| Core | No. 3 | No. 4 | No. 5 | No. 2 | No. 3 | No. 6 | No. 4 | No. 1 |
| Core hardness, mm | 4.0 | 4.2 | 4.6 | 4.0 | 4.2 | 4.2 | 4.2 | 3.0 |
| Cover | A | A | C | C | B | A | D | A |
| Cover thickness, mm | 2.0 | 2.0 | 2.3 | 1.8 | 2.0 | 2.0 | 2.0 | 2.0 |
| Flying distance, HS = 40 m/s | | | | | | | | |
| Carry, m | 201.0 | 201.5 | 200.8 | 202.0 | 200.5 | 201.3 | 200.0 | 198.5 |
| Total, m | 215.0 | 214.9 | 215.2 | 214.5 | 215.0 | 215.1 | 213.5 | 212.0 |
| Feeling | VS | VS | VS | VS | VS | VS | Soft | Hard |
| Durability | Fair | Fair | Fair | Fair | Fair | Fair | Poor | Fair |

It is evident from Table 3 that the ball of Comparative Example 1 was less durable and the ball of Comparative Example 2 gave an unpleasant feel and both traveled shorter flying distances. The balls of Examples 1 to 6 are superior in flying distance, durability and feeling.

Although some preferred embodiments have been described, many modifications and variations may be made thereto in the light of the above teachings. It is therefore to be understood that within the scope of the appended claims, the invention may be practiced otherwise than as specifically described.

We claim:

1. A solid golf ball comprising a solid core and a cover enclosing the core, said solid core having a distortion of at least 3.5 mm under a load of 100 kg, and said cover being composed mainly of an ionomer resin and having a Shore D hardness in the range of 50 to 60 and a 300% modulus in the range of 15 to 35 MPa.

2. The golf ball of claim 1 wherein said cover has a thickness in the range of 1.3 to 2.4 mm.

3. The golf ball of claim 1 wherein said core has a distortion in the range of 3.5 to 5.0 mm under a load of 100 kg.

4. The golf ball of claim 1 wherein said solid core has a diameter in the range of 37.9 to 40.1 mm.

5. The golf ball of claim 1 wherein said solid core comprises an inner layer and an outer layer.

6. The golf ball of claim 5 wherein said inner layer has a diameter in the range of 15.0 to 37.5 mm and said outer layer has a thickness in the range of 1.3 to 2.4 mm.

7. The golf ball of claim 5 wherein said outer layer has a Shore D hardness in the range of 25 to 60.

8. The golf ball of claim 5 wherein said inner layer has a distortion of at least 3.8 mm under a load of 100 kg.

9. The golf ball of claim 1 wherein said cover has a Shore D hardness in the range of 55–60 and a 300% modulus in the range of 17–32 MPa.

10. The golf ball of claim 1 wherein said cover has a thickness in the range of 1.5 to 2.3 mm.

11. The golf ball of claim 1 wherein said core has distortion of 3.8 to 4.8 mm under a load of 100 kg.

* * * * *